US006375374B2

(12) United States Patent
Gueret

(10) Patent No.: US 6,375,374 B2
(45) **Date of Patent: *Apr. 23, 2002**

(54) DEVICE FOR PACKAGING AND APPLYING A SUBSTANCE, IN PARTICULAR A COSMETIC

(75) Inventor: Jean-Louis Gueret, Paris (FR)

(73) Assignee: L'Oreal, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/563,507

(22) Filed: May 3, 2000

(30) Foreign Application Priority Data

May 7, 1999 (FR) ..... 99 05853

(51) Int. Cl.[7] ..... A46B 11/00

(52) U.S. Cl. ..... 401/122; 401/121; 401/126; 401/129

(58) Field of Search ..... 401/122, 121, 401/118, 126, 129, 128, 130

(56) References Cited

U.S. PATENT DOCUMENTS 3,084,374 A * 4/1963 Ziegler ..... 401/122
3,219,045 A 11/1965 Kamberksy
3,662,769 A * 5/1972 Vasas et al. ..... 401/122
3,921,650 A 11/1975 Montgomery
5,349,972 A * 9/1994 Dirksing et al. ..... 401/122
5,697,720 A * 12/1997 Lhuisset ..... 401/122
6,010,265 A * 1/2000 Bouix ..... 401/122

FOREIGN PATENT DOCUMENTS

| | | |
|---|---|---|
| GB | 683932 | 12/1952 |
| WO | WO 88/02608 | 4/1988 |
| WO | WO 97/07705 | 3/1997 |

* cited by examiner

*Primary Examiner*—David J. Walczak
(74) *Attorney, Agent, or Firm*—Oliff & Berridge, PLC

(57) ABSTRACT

A device for packaging and applying a substance, in particular a cosmetic, the device comprising a receptacle for containing said substance, an applicator provided with an applicator element, and a wiper member having an elastically deformable wall with at least one slot through which the applicator element can pass and defining wiper lips, wherein said elastically deformable wall is suitable, under the effect of axial stress exerted by the applicator, for taking up different first and second configurations respectively during insertion and withdrawal of the applicator, and wherein said elastically deformable wall is made to have an initial shape at rest and in the absence of the applicator that is not plane, said initial shape being selected in such a manner that the wiper lips press on the applicator with different amounts of force respectively while the applicator is being inserted and while it is being withdrawn because of the deformations to which said elastically deformable wall is subjected to make it pass from its initial shape to one of said configurations.

86 Claims, 7 Drawing Sheets

DEVICE FOR PACKAGING AND APPLYING A SUBSTANCE, IN PARTICULAR A COSMETIC

The present invention relates to a device for packaging and applying a substance, in particular a cosmetic.

The invention relates more particularly to a device of the type comprising a receptacle for containing said substance, an applicator provided with an applicator element, and a wiper member having an elastically deformable wall pierced by at least one slot defining wiping lips and through which an applicator element can pass.

BACKGROUND OF THE INVENTION

Numerous devices of that type are known.

Nevertheless, there exists a need to improve the quality of the wiping of the applicator element since the quality of the resulting makeup depends thereon to a large extent.

OBJECTS AND SUMMARY OF THE INVENTION

The invention seeks to propose a novel device for packaging and applying a substance, which device is relatively simple in structure and provides better-quality wiping of the applicator element.

The device of the invention is of the above-specified type, wherein the elastically deformable wall is suitable, under the effect of axial stress exerted by the applicator, for taking up different first and second configurations respectively during insertion and withdrawal of the applicator, and wherein said elastically deformable wall is made to have an initial shape at rest and in the absence of the applicator that is not plane, said initial shape being selected in such a manner that the wiper lips press on the applicator with different amounts of force respectively while the applicator is being inserted and while it is being withdrawn because of the deformations to which said elastically deformable wall is subjected to make it pass from its initial shape to one of said configurations.

Because of the invention, a device for packaging and applying a substance is made available in which the wiper member bears against the applicator in different ways depending on whether it is being inserted into the receptacle or extracted therefrom.

The invention makes it possible to ensure that the wiper lips do not lose their ability to wipe the applicator element in satisfactory manner following prolonged storage of the applicator in the receptacle.

The applicator element can thus be very fine.

Preferably, when the elastically deformable wall is in its initial shape, the wiper lips are substantially touching.

This ensures that the substance contained in the receptacle does not dry out.

In addition, in the event of the receptacle being accidentally tipped over, the substance is prevented from spreading to the outside.

Preferably, bringing said elastically deformable wall into one of the above-mentioned first and second configurations causes the wiper lips automatically take up a position in which they are no longer naturally touching.

Advantageously this characteristic is made use of to reduce the stress exerted on the wiper lips by the applicator when the applicator is in its storage position, or to reduce the force exerted by the wiper lips on the applicator element while the applicator is being withdrawn.

Preferably there is only one slot.

Preferably, the slot is made in the end wall of a generally concave portion of the elastically deformable wall.

In a first embodiment of the invention, when the elastically deformable wall is in its initial shape, the concave side of said portion faces towards the inside of the receptacle.

Thus, when the applicator is inserted into the receptacle, this portion inverts, thereby opening the slot.

The slot opened by the elastically deformable wall inverting presents relatively little resistance to the movement of the applicator since the wiper lips do not press strongly thereagainst.

When the applicator is extracted from the receptacle, the elastically deformable wall inverts again and the concave side of the portion through which the slot passes again faces towards the inside of the receptacle.

The wiper lips then tend to press more strongly against the applicator than while it is being inserted into the receptacle.

The applicator element is thus subjected to thorough wiping.

In a second embodiment of the invention, when the elastically deformable wall is in its initial shape, the concave side of said portion faces towards the mouth of the receptacle.

Thus, when the applicator is inserted into the receptacle, the portion through which the slot passes remains with its concave side facing towards the opening of the receptacle.

As a result, the wiper lips tend to press strongly against the applicator.

However, when the applicator is withdrawn, the elastically deformable wall changes configuration and the portion through which the slot passes becomes concave facing towards the inside of the receptacle.

Because of this deformation of the elastically deformable wall, the wiper lips tend to move apart and to press with relatively little force against the applicator element, which element is therefore wiped less thoroughly than in the above-mentioned first embodiment of the invention.

In a particular application, the device includes a limiter member for limiting deformation of the elastically deformable wall while the applicator is being withdrawn.

The limiter member may be organized to limit the upward travel of the wiper lips while the applicator is being withdrawn.

When the portion through which the slot passes inverts while the applicator is being withdrawn, the limiter member can limit the extent of its inversion.

In a particular embodiment, the limiter member is secured to a neck of the receptacle which serves to fix a closure cap.

In a particular embodiment, the wiper member is fixed to the receptacle via an annular rib.

The applicator may comprise a rod which is enlarged at its bottom end so as to form a housing for fixing the applicator element.

In a particular embodiment, the thickness of the applicator element, at least during wiping, is less than the thickness of the rod measured in the region thereof which comes into contact with the wiper member while the applicator is in its storage position inside the receptacle.

In a particular embodiment, the rod of the applicator is flat.

The rod of the applicator can be hollow, so as to limit the stresses exerted by the applicator on the wiper member when the applicator is in place in the receptacle.

In a particular embodiment, the elastically deformable wall of the wiper member is made of elastomer.

In a particular embodiment, said slot is extended at its ends by cuts serving to make the wiper lips more mobile during insertion and withdrawal of the applicator.

At least one of the edges of the slot can have a chamfer.

The chamfer can be used in particular to make a fine membrane connecting together the edges of the slot which is integrally molded with the elastically deformable wall and which is broken after the molding operation.

BRIEF DESCRIPTION OF THE DRAWINGS

Other characteristics and advantages of the present invention will appear on reading the following detailed description of non-limiting embodiments of the invention, and on examining the accompanying drawings, in which.

MORE DETAILED DESCRIPTION

Figure 1:
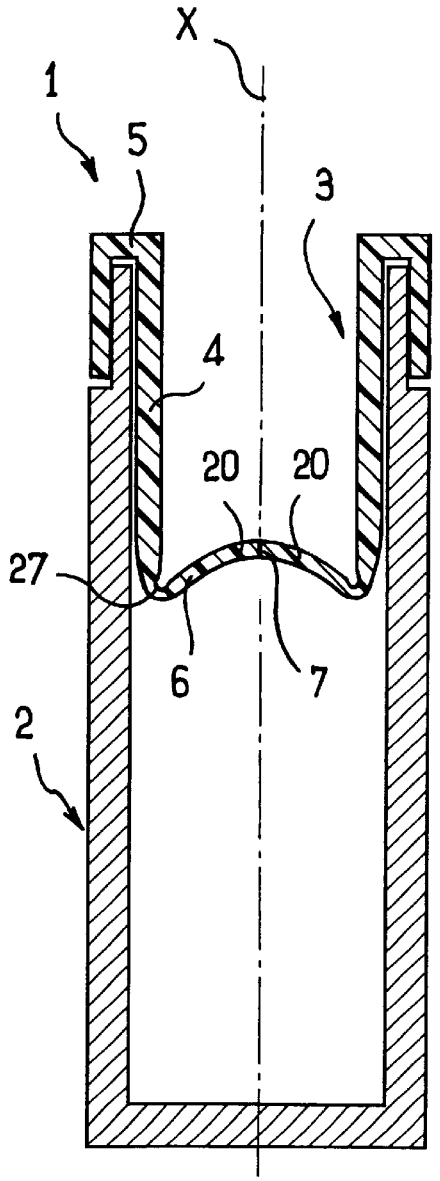
FIG. 1 is a diagrammatic axial section view of a device for packaging and applying a substance that constitutes a first embodiment of the invention, the applicator being withdrawn.
Figure 2:
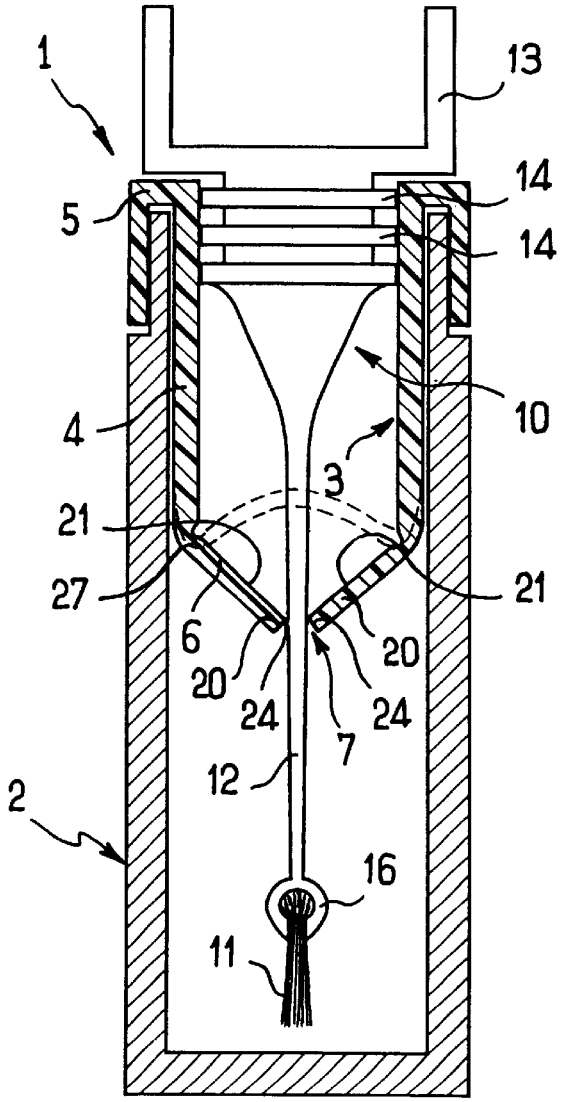
FIG. 2 shows the FIG. 1 receptacle with the applicator in its storage position inside the receptacle.
Figure 3:
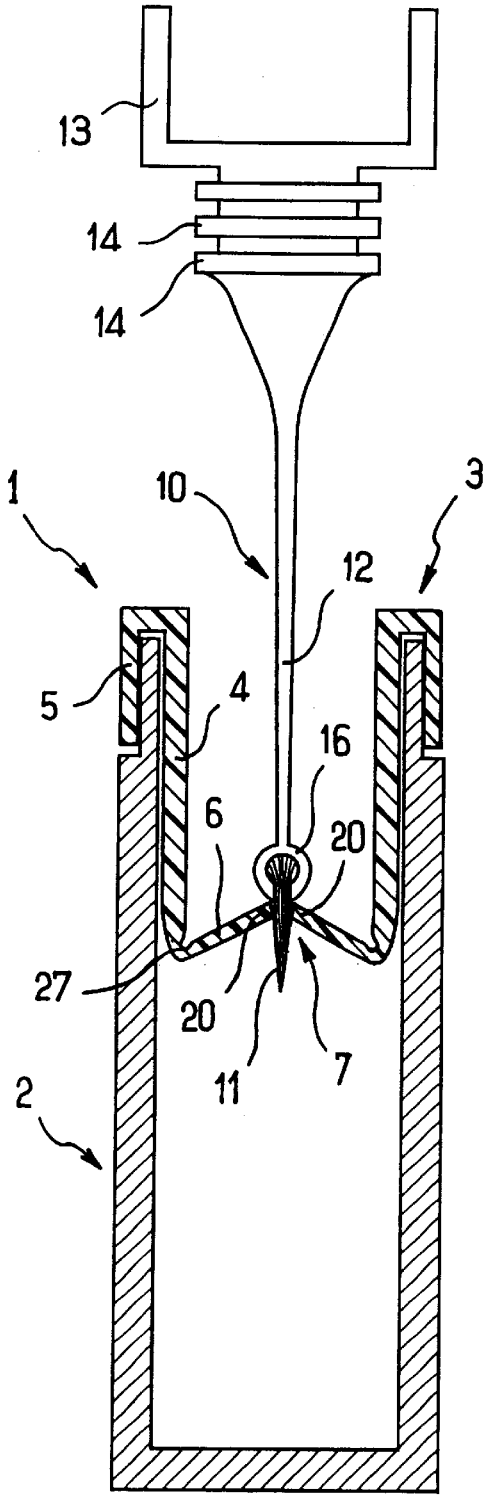
FIG. 3 shows the FIG. 1 receptacle while the applicator is being withdrawn.

The device 1 for packaging and applying a substance, and shown in part in FIGS. 1 to 3, comprises a receptacle 2 having an axis X, the receptacle being open at its top end and being suitable for containing makeup, such as mascara for example.

A wiper member 3 is fixed inside the receptacle 2 by any appropriate means, e.g. by adhesive or by heat sealing.

In the example described, the wiper member 3 has a generally tubular wall 4 about the axis X which is extended at its top end by an annular rim 5 serving to fix it on the top end of the receptacle 2, and connected at its bottom end to an end wall 6 which, when at rest and in the absence of an applicator, presents a shape that is generally concave towards the inside of the receptacle, as can be seen in FIG. 1.

A slot 7 passes through the center of the wall 6, and the longitudinal edges of the slot extend in a direction that is perpendicular to the section plane of FIG. 1.

The slot 7 defines two opposite wiper lips 20 that are elastically deformable and whose ends constitute the above-mentioned longitudinal edges.

The wiper member 3 can be made of an elastomer, for example such as a silicone, nitrile EPDM, butyl, or latex elastomer, or a polyethylene, polypropylene, polyurethane, polystyrene, PVC, or EVA thermoplastic elastomer, said list naturally not being limiting.

The end wall 6 is connected to the tubular wall 4 by an annular zone 27 of reduced thickness.

The receptacle 2 is designed to receive an applicator 10 which is shown in FIG. 2 in its storage position.

The applicator 10 comprises an applicator element 11 which can be a brush as in the example described, or a flocked body, or a foam.

The applicator element 11 is fixed to the bottom end of a rod 12.

The applicator element can be flat and on the axis of the rod.

The top end of the rod 12 is secured to a mounting insert 13 for inserting in a cap (not shown).

At its top portion, the rod 12 carries a series of annular ribs 14 which are designed to press against the inside surface of the tubular portion 4 of the wiper member 3 to seal closure of the receptacle during storage.

As can be seen in FIG. 2, the rod 12 is quite fine in its region that comes into contact with the wall 6 of the wiper member 3 in the storage position.

The rod 12 thickens at its bottom end so as to form a swelling 16 that defines a housing for fixing the applicator element 12.

When the wiper member is in its initial shape at rest, and in the absence of the applicator, the wiper lips 20 touch, as shown in FIG. 1.

When the applicator is inserted into the receptacle, the applicator element 11 presses against the end wall 6 which inverts, changing shape, passing from a shape that is generally concave towards the inside of the receptacle to a shape that is generally concave towards the mouth of the receptacle, as shown in FIG. 2. Accordingly, the end wall 6 has first and second inverted configurations in relation to a median plane, which is perpendicular to the longitudinal axis X of the applicator. The first and second configurations are substantially symmetrical with respect to the median plane.

This change in the configuration of the end wall 6 is accompanied by internal constraints that tend to open the slot 7.

Thus, the wiper lips 20 bear rather weakly against the rod 12 of the applicator since in the configuration of FIG. 2 they naturally do not touch each other.

The wiper lips 20 press against the rod 12 via their top faces 21 and the edges 24 of said faces.

When the applicator is withdrawn from the receptacle, the end wall 6 accompanies the upward displacement of the rod 12 and inverts again.

The end wall 6 thus changes configuration, going from a shape that is generally concave towards the mouth of the receptacle to a shape that is generally concave towards the inside of the receptacle, as shown in FIG. 3.

The change in the configuration of the end wall 6 during insertion of the applicator and during withdrawal thereof is facilitated by the presence of the annular zone 27 of reduced thickness.

In addition, the changeover of the end wall 5 from the configuration of FIG. 2 to the configuration of FIG. 3 is facilitated by the existence of the swelling 16 above the applicator element.

It will be observed that the friction of the wiper lips 20 against the applicator is sufficient for the end wall 6 to be able to be able to accompany the movement of the applicator and change configuration. Accordingly, the end wall 6 is entirely axially movable during insertion and withdrawal of the applicator.

In addition, the tubular wall 4 is sufficiently rigid to avoid being inverted when the applicator is extracted from the receptacle.

Because the wiper lips 20 in the configuration of FIG. 2 are naturally not touching, they are compressed to a small extent only by the presence of the applicator during storage, and this ensures that they do not acquire permanent deformation which would be prejudicial to proper wiping of the applicator element.

It will also be observed that while the applicator is being inserted into the receptacle, the wiper lips 20 move apart further as the end wall 6 is deformed towards the bottom of the receptacle.

This reduces the risk of the wiper lips 20 being damaged in the event of the applicator being inserted very quickly into the receptacle.

Figure 4:
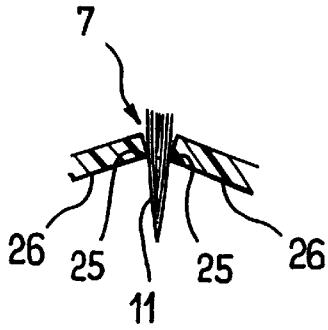
FIG. 4 shows a detail of FIG. 3.

In the configuration of FIG. 3, the wiper lips 20 bear strongly via the edges 25 of their bottom faces 26 against the applicator element 11, as shown in FIG. 4.

This makes it possible to provide a wiper member that is capable of wiping an applicator element that is extremely fine.

In addition, even if the wiper lips 20 do acquire permanent downward deformation during prolonged storage of the applicator 10 in the receptacle, wiping takes place while the wiper lips are urged to move upwards, such that the above-mentioned permanent deformation serves merely to generate additional force tending to press the wiper lips against the applicator element.

The slot 7 can be made by cutting using a blade, or in a variant can be the result of the way the wiper member is molded, possibly after breaking a fine membrane interconnecting the wiper lips 20. Under such circumstances, the edges of the wiper lips are advantageously chamfered.

Figure 5:
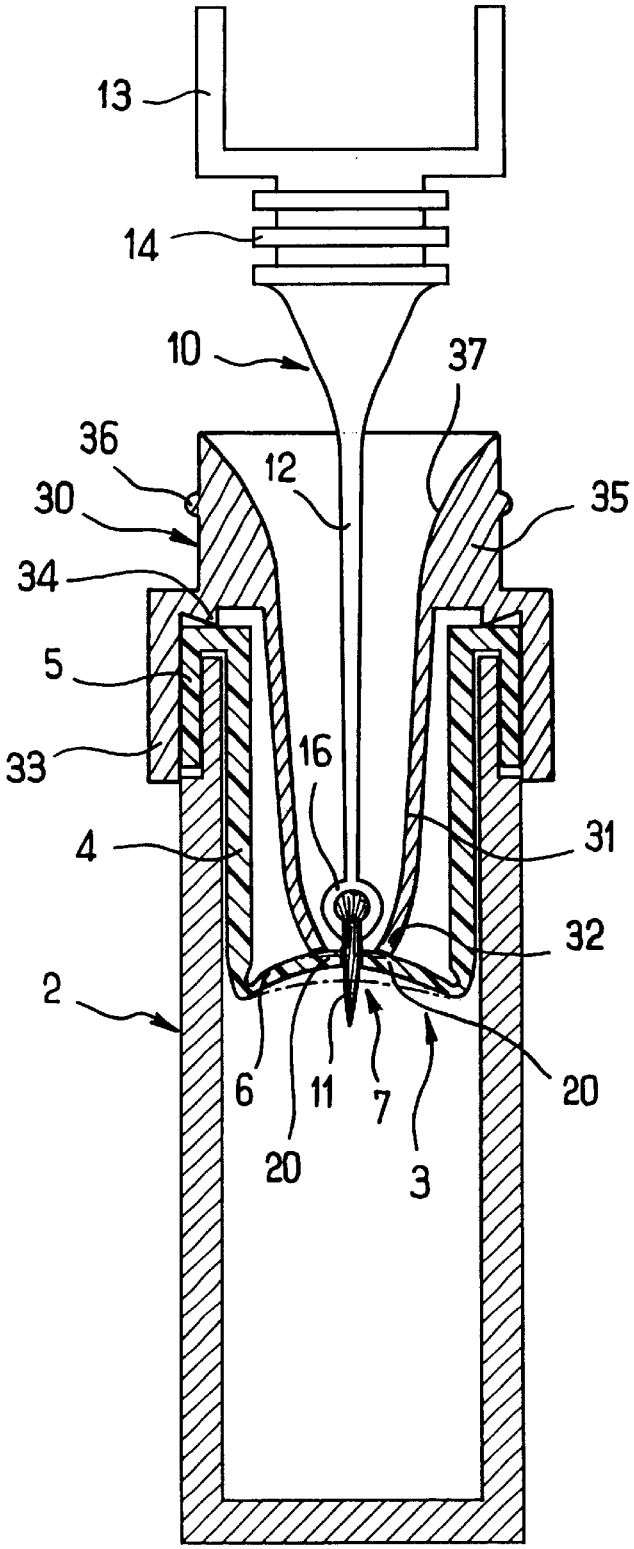
FIG. 5 is a diagrammatic axial section view of a device for packaging and applying a substance that constitutes a second embodiment of the invention, the device being shown while the applicator is being withdrawn.

The embodiment of FIG. 5 differs from that of FIGS. 1 to 3 solely by the fact that a limiter member 30 is inserted into the mouth of the receptacle.

This limiter member 30 has a bottom portion 31 extending inside the receptacle above the end wall 6 of the wiper member.

The bottom end 32 of the limiter member 30 extends at a predetermined distance from the end wall 6 when the end wall is at rest, in the absence of an applicator.

The limiter member 30 is secured to the receptacle by any conventional means, and in the embodiment described, it has a tubular skirt 33 that covers the annular rim 5 of the wiper member 3.

The limiter member 30 also has an annular lip 34 which pinches the annular rim 5 against the receptacle 2 in order to seal the assembly.

The top portion of the limiter member 30 forms a neck 35 fitted with an outside rib 36 serving to snap-fasten the cap in which the mounting insert 13 is inserted.

The inside surface of the neck 35 and the inside surface of the bottom portion 31 form an insertion cone facilitating insertion of the applicator into the receptacle.

The limiter member 30 serves to limit upward displacement of the end wall 6 when the applicator is withdrawn.

Figure 6:
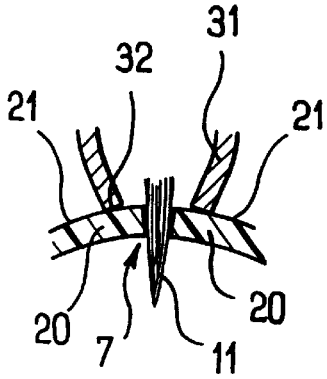
FIG. 6 shows a detail of FIG. 5.

More particularly, as shown in FIG. 6, the top faces 21 of the wiper lips 20 come into abutment on withdrawal of the applicator against the bottom end 32, thereby preventing the wiper lips 20 from moving further apart, and thus increasing the contact pressure they apply on the applicator element 11, thereby ensuring thorough wiping.

It will be understood that it is easy to act on the degree to which the applicator element is wiped by modifying the axial position of the limiter member 30.

Figure 7:
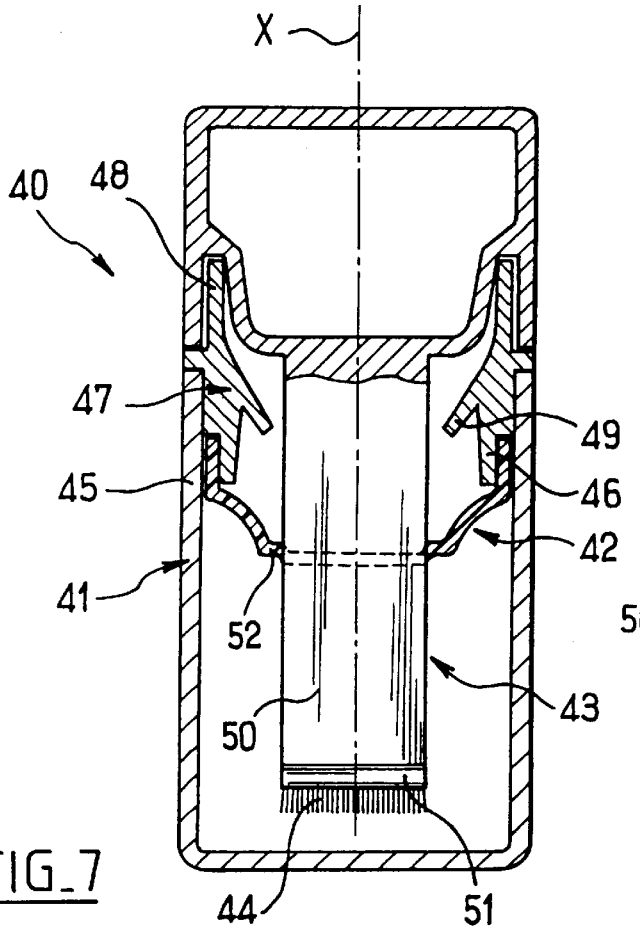
FIG. 7 is a diagrammatic axial section view of a device for packaging and applying a substance that constitutes a third embodiment of the invention, the applicator being shown in its storage position inside the receptacle.

FIG. 7 shows a device 40 constituting a variant embodiment.

The device 40 comprises a receptacle 41 containing the substance, a wiper member 42, and an applicator 43 that is provided at its bottom end with an applicator element 44.

The receptacle 41 comprises a body 45 that is open at its top end, and in which an insert 47 is fixed having at its top end a neck 46 that serves to hold the applicator in the storage position, and at its bottom end an annular lip 49 forming an insertion cone for guiding the applicator 43 as it enters into the receptacle 41.

The insert 47 also has at its bottom end a skirt 46 that is used for mounting a wiper member 42.

The applicator 43 has a flat rod 50 extending parallel to the section plane of FIG. 7.

The rod 50 has a swelling 51 at its bottom end, defining a housing that is used for fixing the applicator element 44, which element can be constituted, for example, by a brush whose bristles extend downwards substantially in the direction of the axis of the receptacle.

When the applicator 43 is in place inside the receptacle 41, the general shape of the wiper member 42 is that of a dish, being concave towards the mouth of the receptacle, as shown in FIG. 7.

Figure 9:
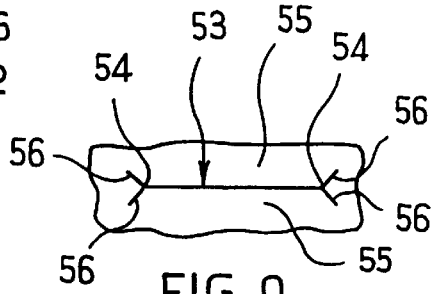
FIGS. 9 to 11 show cuts of various shapes formed at the ends of the slot of the wiper member.

The end wall 52 of the wiper member has a slot 53 passing therethrough which is shown in plan view in FIG. 9 as seen looking along the axis X.

The slot 53 extends along a plane region of the end wall 52 and it is extended at its axial ends 54 by cuts 56 designed to facilitate pivoting of the wiper lips 55.

The wiper lips 55 touch at rest in the absence of an applicator 43, as can be seen in FIG. 9.

The cuts 56 can form a V-shape on either side of the slot 53 with the apex of the V-shape lying on the axis of the slot and with its limbs flaring as they go away from the slot.

Figure 10:
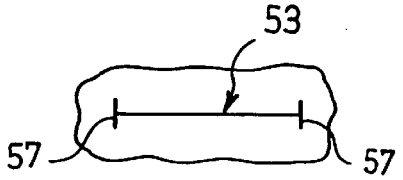
Figure 11:
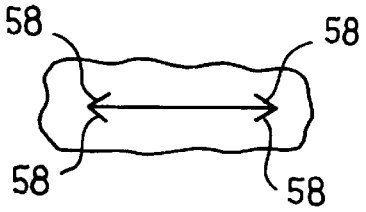

The cuts (reference 57) could alternatively extend perpendicularly to the axis of the slot, as shown in FIG. 10, They could also (reference 58) form V-shapes whose limps flare going towards the axis X, as shown in FIG. 11.

In its initial shape, the end wall 52 is concave towards the inside of the receptacle, and the slot 53 is closed.

Figure 8:
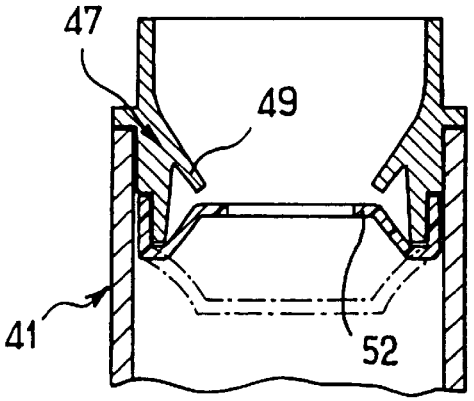
FIG. 8 shows the configuration of the wiper member when the applicator is withdrawn.

When the applicator 43 is inserted into the receptacle, the applicator element 44 displaces the end wall 52 axially downwards and the end wall takes up the configuration shown in chain-dotted lines in FIG. 8.

In this configuration, the wiper lips 55 do not touch because of internal stresses associated with the end wall 52 being deformed when the applicator is inserted.

When the applicator is extracted from the receptacle, the end wall 52 inverts and takes up a configuration in which it is concave towards the inside of the receptacle, as it is when at rest and in the absence of any applicator.

The lip 49 can be configured in such a manner as to serve as a limiter member, like the limiter member 30 described above.

Figure 12:
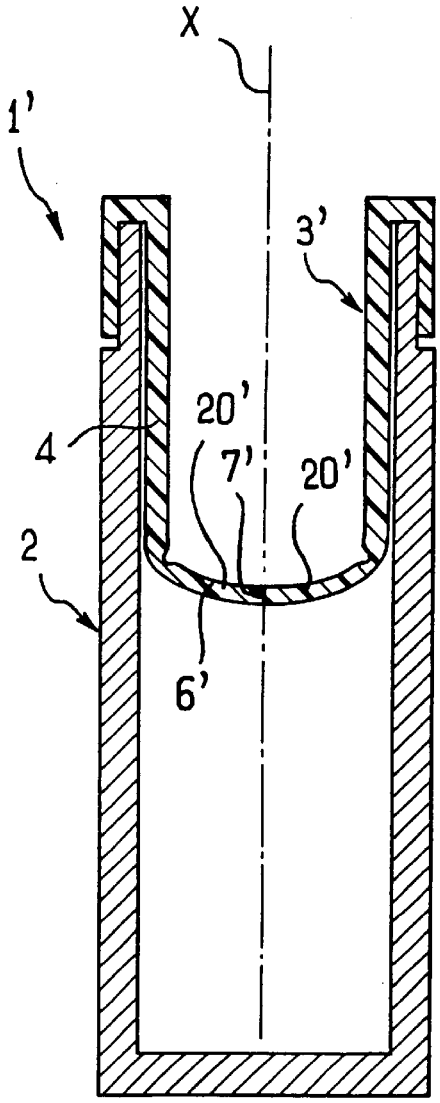
FIG. 12 is a diagrammatic axial section view of a device for packaging and applying a substance that constitutes a fourth embodiment of the invention, the applicator being withdrawn.
Figure 13:
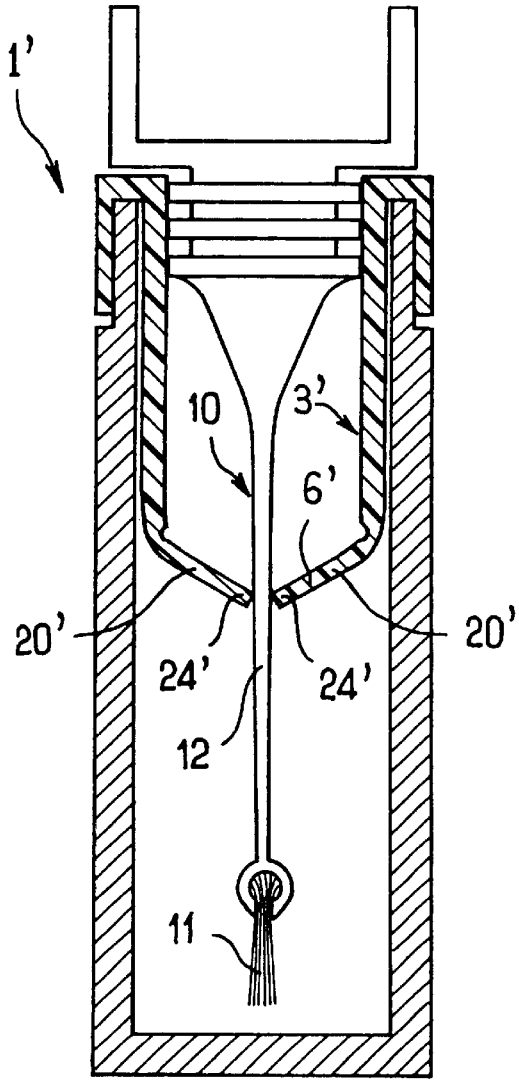
FIG. 13 shows the FIG. 12 receptacle with the applicator in place inside the receptacle.
Figure 14:
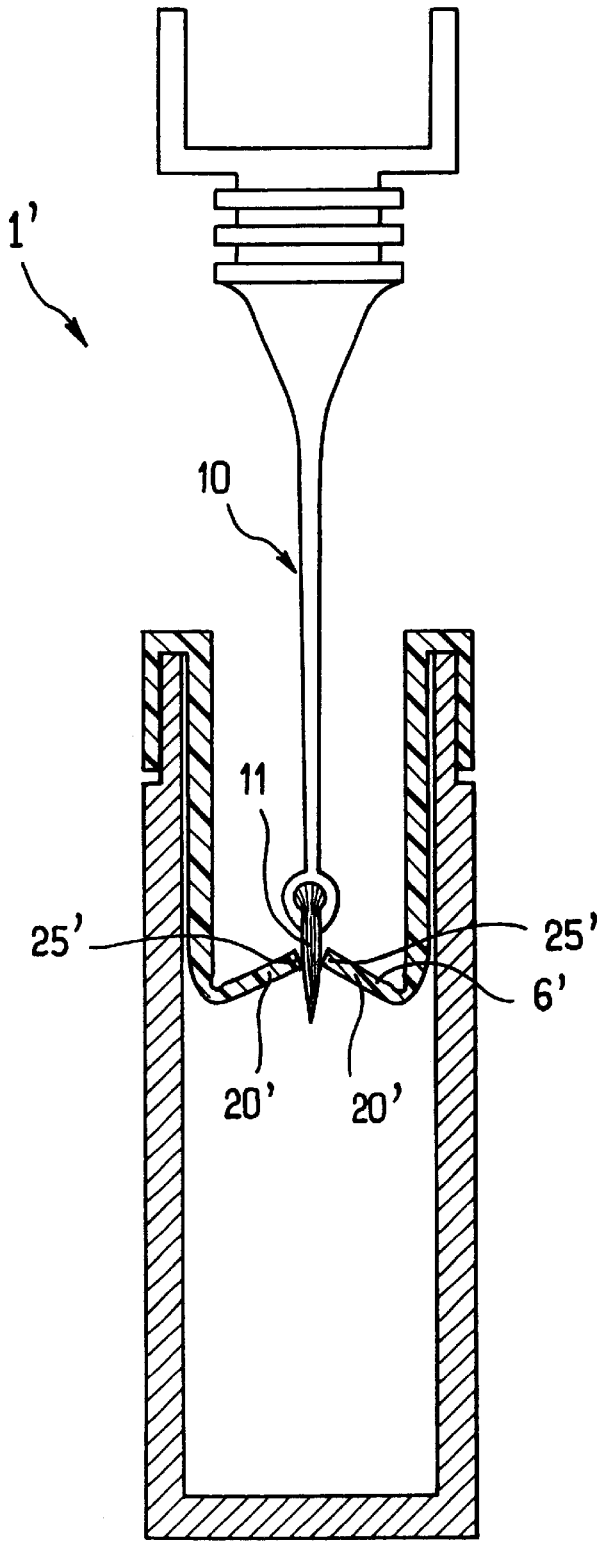
FIG. 14 shows the FIG. 12 receptacle at the moment the applicator is withdrawn.

FIGS. 12 to 14 show a device 1' which differs from that described with reference to FIGS. 1 to 3 by the fact that the end wall 6' of the wiper member 3' when at rest and in the absence of an applicator presents a shape that is generally concave towards the mouth of the receptacle.

A slot 7' analogous to the slot 7 of the device 1 described above passes through the end wall 6' and the thickness of the end wall is less than that of the tubular wall 4.

When the applicator 10 is in place in the receptacle, the wiper lips 20' are deformed towards the inside of the receptacle as can be seen in FIG. 13, and they bear against the rod 12 of the applicator via the edges 24' of their top faces.

The wiper lips 20' press quite strongly against the applicator rod.

While the applicator 10 is being withdrawn, the end wall 6' inverts and its wiper lips 20' press via their bottom faces against the applicator element 11, as can be seen in FIG. 14.

Inversion of the end wall 6' during withdrawal of the applicator has the consequence of causing the wiper lips 20' to tend to move apart because of the internal constraints in the wiper member, thereby causing them to press less strongly against the applicator than during insertion thereof.

As a result the applicator element 11 is wiped less thoroughly than in the embodiment of FIGS. 1 to 3.

It will thus be understood that by means of the invention it is possible to obtain wiping that is more or less thorough depending on the initial shape given to the wiper member.

Figure 15:
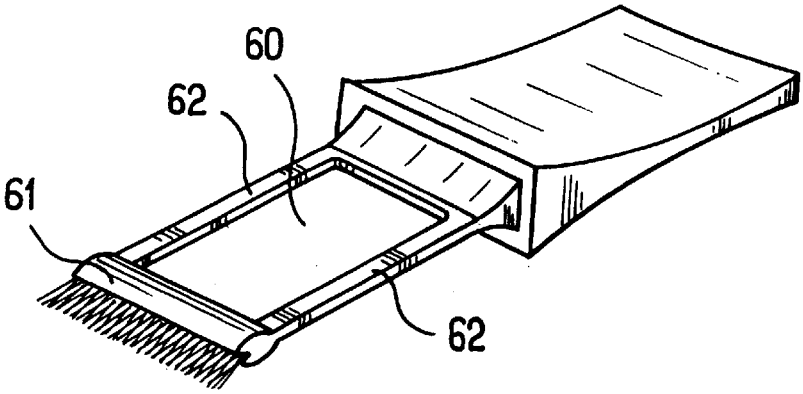
FIG. 15 shows a variant embodiment of the applicator of FIG. 7.

FIG. 15 shows an applicator which differs from that shown in FIG. 7 by the fact that the flat rod has a central opening which extends in the example described over practically the entire length of the rod.

The end portion 61 of the applicator to which the applicator element is connected is thus itself connected to the handle portion via two parallel branches 62.

Figure 16:
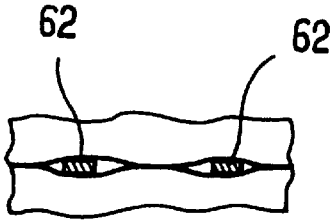
FIG. 16 shows how the wiper lips press against the applicator rod at rest.

As can be seen in FIG. 16, the presence of the opening 60 makes it possible to minimize the stresses exerted by the applicator on the lips of the wiper member since the slot can close between the branches 62.

Figure 17:
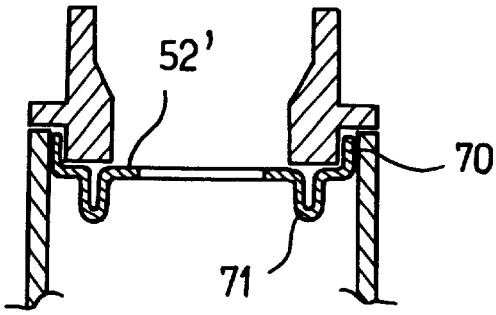
FIG. 17 is a diagrammatic axial section of a wiper member constituting a fifth embodiment of the invention.

The embodiment of FIG. 17 is a variant of the embodiment of FIGS. 7 and 8.

In this embodiment, the end wall 52' has a plane center region which is connected via a fold 71 to a peripheral region 70 for fixing to the receptacle.

The width of the fold 71 can vary on going round the axis X so as to enable the end wall 52' to invert properly.

Figure 18:
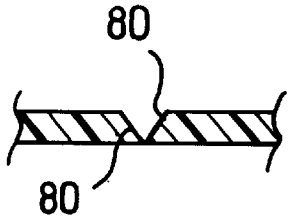
FIG. 18 shows a chamfer made on the wiper lips.

FIG. 18 shows a chamfer 80 formed on each of the wiper lips.

Naturally, the invention is not limited to the embodiments described above.

In particular, the wiper member can be made with other shapes that are adapted to the shape of the applicator element.

The wiper member can have preferred deformation zones for increasing the mobility of the wiper lips while the applicator is being withdrawn and/or returned.

What is claimed is:

1. A device for packaging and applying a substance, the device comprising a receptacle for containing said substance, an applicator provided with an applicator element, and a wiper member having an elastically deformable wall with at least one slot through which the applicator element can pass and defining wiper lips, wherein said elastically deformable wall is suitable, under the effect of axial stress exerted by the applicator, for taking up different first and second configurations respectively during insertion and withdrawal of the applicator, and wherein said elastically deformable wall has a part which is entirely axially movable during insertion and withdrawal of the applicator and that is made to have an initial shape at rest and in the absence of the applicator that is not plane, said initial shape being selected in such a manner that the wiper lips press on the applicator with different amounts of force respectively while the applicator is being inserted and while it is being withdrawn because of the deformations to which said elastically deformable wall is subjected to make said elastically deformable wall pass from its initial shape to one of said configurations.

2. A device according to claim 1, wherein, when the elastically deformable wall is in said initial shape, the wiper lips are substantially touching.

3. A device according to claim 2, wherein bringing said elastically deformable wall into one of the first and second configurations causes the wiper lips to take up a position in which they are no longer naturally touching.

4. A device according to claim 1, wherein there is only one slot.

5. A device according to claim 1, wherein the slot is made in the end wall of a generally concave portion of the elastically deformable wall.

6. A device according to claim 5, wherein said portion has a concave side and the receptacle has a mouth and, when the elastically deformable wall is in its initial shape, said concave side of said portion faces towards said mouth of the receptacle.

7. A device according to claim 1, further including a limiter member for limiting deformation of the elastically deformable wall while the applicator is being withdrawn.

8. A device according to claim 7, wherein the wiper lips move upwardly while the applicator is being withdrawn and the limiter member is organized to limit the upward travel of the wiper lips while the applicator is being withdrawn.

9. A device according to claim 7, wherein the elastically deformable wall inverts during withdrawal of the applicator, and the limiter member is organized to limit the extent of this inversion.

10. A device according to claim 7, wherein the limiter member is secured to a neck of the receptacle, said neck serving to fix a closure cap.

11. A device according to claim 1, wherein the wiper member is fixed to the receptacle via an annular rim.

12. A device according to claim 1, wherein the applicator comprises a rod which is enlarged at its bottom end so as to form a housing for fixing the applicator element.

13. A device according to claim 12, wherein both the applicator element and the rod have a thickness and the rod has a region which comes into contact with the wiper member while the applicator is in a storage position inside the receptacle and wherein said thickness of the applicator element, at least while the applicator element is being wiped, is less than said thickness of the rod measured in said region.

14. A device according to claim 1, wherein the rod is flat.

15. A device according to claim 14, wherein the rod is open.

16. A device according to claim 1, wherein the elastically deformable wall of the wiper member is made of elastomer.

17. A device according to claim 1, wherein said slot is extended at its ends by cuts serving to make the wiper lips more mobile during insertion and withdrawal of the applicator.

18. A device according to claim 1, wherein the slot has edges and at least one of said edges presents a chamfer.

19. A device according to claim 1, wherein the applicator has a rod and said rod is flat.

20. A device according to claim 1, wherein said substance is a cosmetic, and said cosmetic is contained in said receptacle.

21. A device for packaging and applying a substance, the device comprising a receptacle for containing said substance, an applicator provided with an applicator element, and a wiper member having an elastically deformable wall with at least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, said elastically deformable wall is made to have an initial shape at rest and in the absence of the applicator that is not plane, said initial shape being selected in such a manner that the wiper lips press on the applicator with different amounts of force respectively while the applicator is being inserted and while it is being withdrawn because of the deformations to which said elastically deformable wall is subjected to make said elastically deformable wall pass from its initial shape to one of said configurations, the slot is made in the end wall of a generally concave portion of the elastically deformable wall, and said portion has a concave side and the receptacle has an inside and, when the elastically deformable wall is in its initial shape, said concave side of said portion faces towards the inside of the receptacle.

22. A device according to claim 21, wherein the concave side of said portion inverts substantially when the applicator passes therethrough.

23. A device according to claim 21, wherein when the elastically deformable wall is in said initial shape, the wiper lips are substantially touching.

24. A device according to claim 23, wherein there is only one slot.

25. A device according to claim 21, wherein the applicator comprises a flat rod.

26. A device according to claim 21, further comprising a limiter member for limiting deformation of the elastically deformable wall while the applicator is being withdrawn.

27. A device for packaging and applying a substance, the device comprising a receptacle for containing said substance, an applicator provided with an applicator element, and a wiper member having an elastically deformable wall with at least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, and wherein said slot extends along a distance that is less than a dimension of the wall in a direction perpendicular to a direction of insertion and withdrawal of the applicator.

28. A device according to claim 27, wherein when the elastically deformable wall is in an initial shape, the wiper lips are substantially touching.

29. A device according to claim 28, wherein there is only one slot.

30. A device according to claim 27, wherein the applicator comprises a flat rod.

31. A device according to claim 27, further comprising a limiter member for limiting deformation of the elastically deformable wall while the applicator is being withdrawn.

32. A device according to claim 27, wherein said first and second configurations are substantially symmetrical in relation to a median plane.

33. A device for package and applying a substance, the device comprising a receptacle having an inside for containing said substance, an applicator provided with an applicator element, and a wiper member having an elastically deformable wall with at least one slot through which the applicator element can pass and defining wiper lips, wherein:

said elastically deformable wall is suitable, under the effect of axial stress exerted by the applicator, for taking up different first and second configurations respectively during insertion, and withdrawal of the applicator, and said elastically deformable wall has a portion having a concave side facing towards the inside of the receptacle when the elastically deformable wall is in an initial position at rest and in the absence of the applicator.

34. A device according to claim 33, wherein when the elastically deformable wall is in said initial position, the wiper lips are substantially touching.

35. A device according to claim 34, wherein there is only one slot.

36. A device according to claim 33, wherein the applicator comprises a flat rod.

37. A device according to claim 33, further comprising a limiter member for limiting deformation of the elastically deformable wall while the applicator is being withdrawn.

38. A device for packaging and applying a substance, the device comprising a receptacle for containing said substance, an applicator provided with an applicator element, and a wiper member having an elastically deformable wall with at least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, and said slot is closed in a central region of said elastically deformable wall when the elastically deformable wall is in an initial position at rest and in the absence of the applicator.

39. A device according to claim 38, wherein when the elastically deformable wall is in said initial position, the wiper lips are substantially touching.

40. A device according to claim 39, wherein there is only one slot.

41. A device according to claim 38, wherein the applicator comprises a flat rod.

42. A device according to claim 38, further comprising a limiter member for limiting deformation of the elastically deformable wall while the applicator is being withdrawn.

43. A device for packaging and applying a substance, the device comprising a receptacle for containing said substance, an applicator provided with an applicator element, and a wiper member having an elastically deformable wall with a least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, and said wiper member has an annular rim which extends in the absence of the applicator between the receptacle and a member inserted in the receptacle.

44. A device according to claim 43, wherein when the elastically deformable wall is in an initial shape, the wiper lips are substantially touching.

45. A device according to claim 44, wherein there is only one slot.

46. A device according to claim 43, wherein the applicator comprises a flat rod.

47. A device according to claim 43, further comprising a limiter member for limiting deformation of the elastically deformable wall while the applicator is being withdrawn.

48. A device for packaging and applying a substance, the device comprising a receptacle for containing said substance, an applicator provided with an applicator element, and a wiper member having an elastically deformable wall with at least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, and the elastically deformable wall has an annular zone of a thickness less than a thickness of said elastically deformable wall to facilitate the deformation of said elastically deformable wall.

49. A device according to claim 48, wherein when the elastically deformable wall is in an initial shape, the wiper lips are substantially touching.

50. A device according to claim 49, wherein there is only one slot.

51. A device according to claim 48, wherein the applicator comprises a flat rod.

52. A device according to claim 48, further comprising a limiter member for limiting deformation of the elastically deformable wall while the applicator is being withdrawn.

53. A device for packaging and applying a substance, the device comprising a receptacle for containing said substance, an applicator provided with an applicator element, and a wiper member having an elastically deformable wall with at least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, said applicator has a flat rod.

54. A device according to claim 53, wherein when the elastically deformable wall is in an initial shape, the wiper lips are substantially touching.

55. A device according to claim 54, wherein there is only one slot.

56. A device according to claim 53, further comprising a limiter member for limiting deformation of the elastically deformable wall while the applicator is being withdrawn.

57. A device for packaging and applying a substance, the device comprising a receptacle for containing said substance, an applicator provided with an applicator element, and a wiper member having an elasticity deformable wall with at least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, said slot has axial ends and is extended at said axial ends by cuts designed to facilitate pivoting of the wiper lips, and wherein said slot extends along a distance that is less than a dimension of said elastically deformable wall in a direction perpendicular to a direction of insertion and withdrawal of the applicator.

58. A device according to claim 57, wherein when the elastically deformable wall is in an initial shape, the wiper lips are substantially touching.

59. A device according to claim 58, wherein there is only one slot.

60. A device according to claim 57, wherein the applicator comprises a flat rod.

61. A device according to claim 57, further comprising a limiter member for limiting deformation of the elastically deformable wall while the applicator is being withdrawn.

62. A device for packaging and applying a substance, the device comprising a receptacle for containing said substance, an applicator provided with an applicator element, and a wiper member having an elastically deformable wall with at least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, said elastically deformable wall is made to have an initial shape at rest and in the absence of the applicator that is not plane, said initial shape being selected in such a manner that the wiper lips press on the applicator with different amounts of force respectively while the applicator is being inserted and while it is being withdrawn because of the deformations to which said elastically deformable wall is subjected to make said elastically deformable wall pass from its initial shape to one of said configurations, and said first and second configurations are inverted configurations in relation to a median plane.

63. A device according to claim 62, wherein when the elastically deformable wall is in said initial shape, the wiper lips are substantially touching.

64. A device according to claim 63, wherein there is only one slot.

65. A device according to claim 62, wherein the applicator comprises a flat rod.

66. A device according to claim 62, further comprising a limiter member for limiting deformation of the elastically deformable wall while the applicator is being withdrawn.

67. A device according to claim 62, wherein said first and second configurations are substantially symmetrical in relation to said median plane.

68. A device for packaging and applying a substance, the device comprising a receptacle having an inside for containing said substance, an applicator provided with an applicator element, and a wiper member having an elastically deformable wall with at least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, said elastically deformable wall is made to have an initial shape at rest and in the absence of the applicator that is not plane, said initial shape being selected in such a manner that the wiper lips press on the applicator with different amounts of force respectively while the applicator is being inserted and while it is being withdrawn because of the deformations to which said elastically deformable wall is subjected to make said elastically deformable wall pass from its initial shape to one of said configurations, and said elastically deformable wall has a portion having a concave side facing towards the inside of the receptacle when the elastically deformable wall is in said initial shape.

69. A device according to claim 68, wherein when the elastically deformable wall is in said initial shape, the wiper lips are substantially touching.

70. A device according to claim 69, wherein there is only one slot.

71. A device according to claim 68, wherein the applicator comprises a flat rod.

72. A device according to claim 68, further comprising a limiter member for limiting deformation of the elastically deformable wall while the applicator is being withdrawn.

73. A device for packaging and applying a substance, the device comprising a receptacle for containing said substance, an applicator provided with an applicator element, and a wiper member having an elastically deformable wall with at least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, said elastically deformable wall is made to have an initial shape at rest and in the absence of the applicator that is not plane, said initial shape being selected in such a manner that the wiper lips press on the applicator with different amounts of force respectively while the applicator is being inserted and while it is being withdrawn because of the deformations to which said elastically deformable wall is subjected to make said elastically deformable wall pass from its initial shape to one of said configurations, and said slot is closed when the elastically deformable wall is in said initial shape.

74. A device for packaging and applying a substance, the device comprising a receptacle for containing said substance, an applicator provided with an applicator element, and a wiper member having an elastically deformable wall with at least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, said elastically deformable wall is made to have an initial shape at rest and in the absence of the applicator that is not plane, said initial shape being selected in such a manner that the wiper lips press on the applicator with different amounts of force respectively while the applicator is being inserted and while it is being withdrawn because of the deformations to which said elastically deformable wall is subjected to make said elastically deformable wall pass from its initial shape to one of said configurations, and said wiper member has an annular rim which is pinched between the receptacle and a member inserted in the receptacle.

75. A device according to claim 74, wherein the applicator comprises a flat rod.

76. A device according to claim 74, further comprising a limiter member for limiting deformation of the elastically deformable wall while the applicator is being withdrawn.

77. A device for packaging and applying a substance, the device comprising a receptacle for containing said substance, an applicator provided with an applicator element, and a wiper member having an elastically deformable wall at least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, said elastically deformable wall is made to have an initial shape at rest and in the absence of the applicator that is not plane, said initial shape being selected in such a manner that the wiper lips press on the applicator with different amounts of force respectively while the applicator is being inserted and while it is being withdrawn because of the deformations to which said elastically deformable wall is subjected to make said elastically deformable wall pass from its initial shape to one of said configurations, and the elastically deformable wall has an annular zone of reduced thickness to facilitate the deformation of said elastically deformable wall.

78. A device according to claim 77, wherein the applicator comprises a flat rod.

79. A device according to claim 77, further comprising a limiter member for limiting deformation of the elastically deformable wall while the applicator is being withdrawn.

80. A device for packaging and applying a substance, the device comprising a receptacle for containing said substance, an applicator provided with an applicator element, and a wiper member having an elastically deformable wall with a least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, said elastically deformable wall is made to have an initial shape at rest and in the absence of the applicator that is not plane, said initial shape being selected in such a manner that the wiper lips press on the applicator with different amounts of force respectively while the applicator is being inserted and while it is being withdrawn because of the deformations to which said elastically deformable wall is subjected to make said elastically deformable wall pass from its initial shape to one of said configurations, and said applicator has a flat rod.

81. A device according to claim 80, further comprising a limiter member for limiting deformation of the elastically deformable wall while the applicator is being withdrawn.

82. A device for packaging and applying a substance, the device comprising a receptacle for containing said substance, an applicator provided with an applicator element, and a wiper member having an elastically deformable wall with at least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, said elastically deformable wall is made to have an initial shape at rest and in the absence of the applicator that is not plane, said initial shape being selected in such a manner that the wiper lips press on the applicator with different amounts of force respectively while the applicator is being inserted and while it is being withdrawn because of the deformations to which said elastically deformable wall is subjected to make said elastically deformable wall pass from its initial shape to one of said configurations, and said slot has axial ends and is extended at said axial ends by cuts designed to facilitate pivoting of the wiper lips.

83. A device according to claim 82, wherein the applicator comprises a flat rod.

84. A device according to claim 82, further comprising a limiter member for limiting deformation of the elastically deformable wall while the applicator is being withdrawn.

85. A device for packaging and applying a substance, the device comprising a receptacle for containing said substance, an applicator provided with an applicator element, and a wiper member having an elastically deformable wall with at least one slot through which the applicator element can pass and defining wiper lips, wherein:

said elastically deformable wall is suitable, under the effect of axial stress exerted by the applicator, for taking up different first and second configurations respectively during insertion and withdrawal of the applicator, and said first and second configurations are substantially symmetrical inverted configurations in relation to a median plane perpendicular to a longitudinal axis of the applicator.

86. A device according to claim 85, further comprising a limiter member for limiting deformation of the elastically deformable wall while the applicator is being withdrawn.

* * * * *